US010486178B2

(12) United States Patent
Mao

(10) Patent No.: US 10,486,178 B2
(45) Date of Patent: Nov. 26, 2019

(54) INJECTION DEVICE

(71) Applicant: HON HAI PRECISION INDUSTRY CO., LTD., New Taipei (TW)

(72) Inventor: Ching-Yi Mao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 124 days.

(21) Appl. No.: 15/585,306

(22) Filed: May 3, 2017

(65) Prior Publication Data

US 2018/0178231 A1 Jun. 28, 2018

(30) Foreign Application Priority Data

Dec. 24, 2016 (CN) ..... 2016 1 1213621

(51) Int. Cl.
*B05B 11/00* (2006.01)
*B65D 83/00* (2006.01)

(52) U.S. Cl.
CPC ..... *B05B 11/0039* (2018.08); *B65D 83/0005* (2013.01); *B65D 83/0022* (2013.01); *B65D 2205/04* (2013.01)

(58) Field of Classification Search
CPC ..... B05B 11/0039; B65D 83/0005; B65D 83/0022; B65D 2205/04
USPC ..... 222/387
See application file for complete search history.

(56) References Cited

U.S. PATENT DOCUMENTS 3,786,966 A * 1/1974 Behunin ..... E04G 21/20 222/387
6,158,621 A * 12/2000 Keller ..... B05C 17/00583 222/105
7,748,577 B2 * 7/2010 Brugner ..... B05C 17/00576 222/326
2012/0061424 A1 * 3/2012 Obrist ..... B05C 17/00579 222/387

* cited by examiner

*Primary Examiner* — Donnell A Long
(74) *Attorney, Agent, or Firm* — ScienBiziP, P.C.

(57) ABSTRACT

An injection device able to evacuate air bubbles trapped with injectable liquid includes a needle tube, a push rod slidable installed in the needle tube and a piston secured on one end of the push rod. The piston includes a main body and a cover, the main body defines a through hole and an exhaust passage in air communication with the through hole. The cover is secured on the main body to shield the through hole and the exhaust passage, and the cover defines an exhaust hole in air communication with one end of the exhaust passage to allow gas but not the liquid to escape from under the piston.

20 Claims, 6 Drawing Sheets

INJECTION DEVICE

CROSS-REFERENCE TO RELATED APPLICATIONS

This application claims priority to Chinese Patent Application No. 201611213621.3 filed on Dec. 24, 2016 the contents of which are incorporated by reference herein.

FIELD

The subject matter herein generally relates to a food injection field.

BACKGROUND

When using the injection devices to inject liquid for example into food capsules, there is often a space between the piston and liquid in the needle tube. A small amount of gas occupy the space which cannot be discharged from the needle tube. As the piston is pressed, the pressure of the space absorbs the force, thus greater force is needed to push the piston.

BRIEF DESCRIPTION OF THE DRAWINGS

Implementations of the present technology will now be described, by way of example only, with reference to the attached figures.

DETAILED DESCRIPTION

Figure 1:
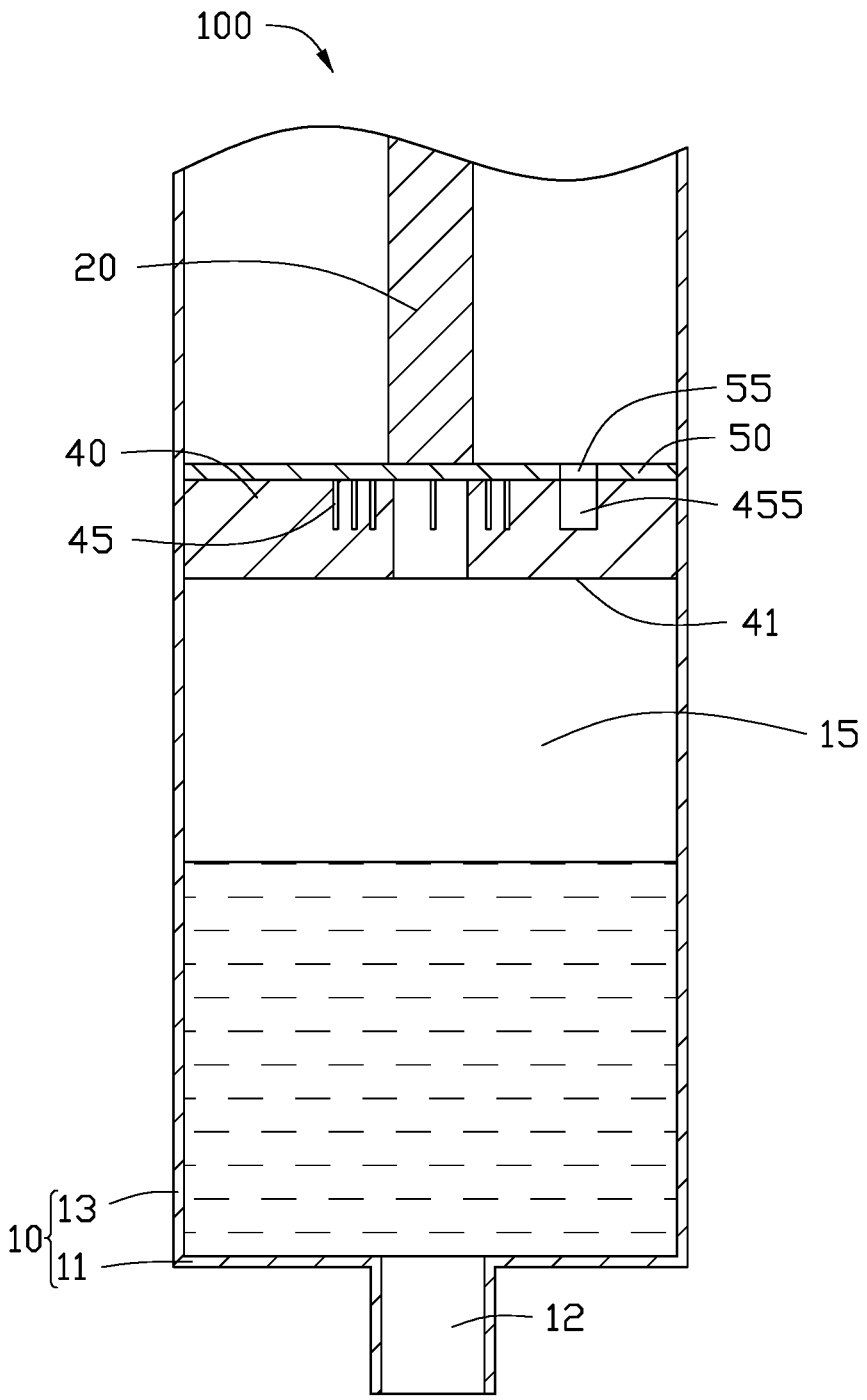
FIG. 1 is a cross-sectional view of an exemplary embodiment of an injection device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

Several definitions that apply throughout this disclosure will now be presented.

The term "outside" refers to a region that is beyond the outermost confines of a physical object. The term "inside" indicates that at least a portion of an object is contained within a boundary formed by another object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

Figure 2:
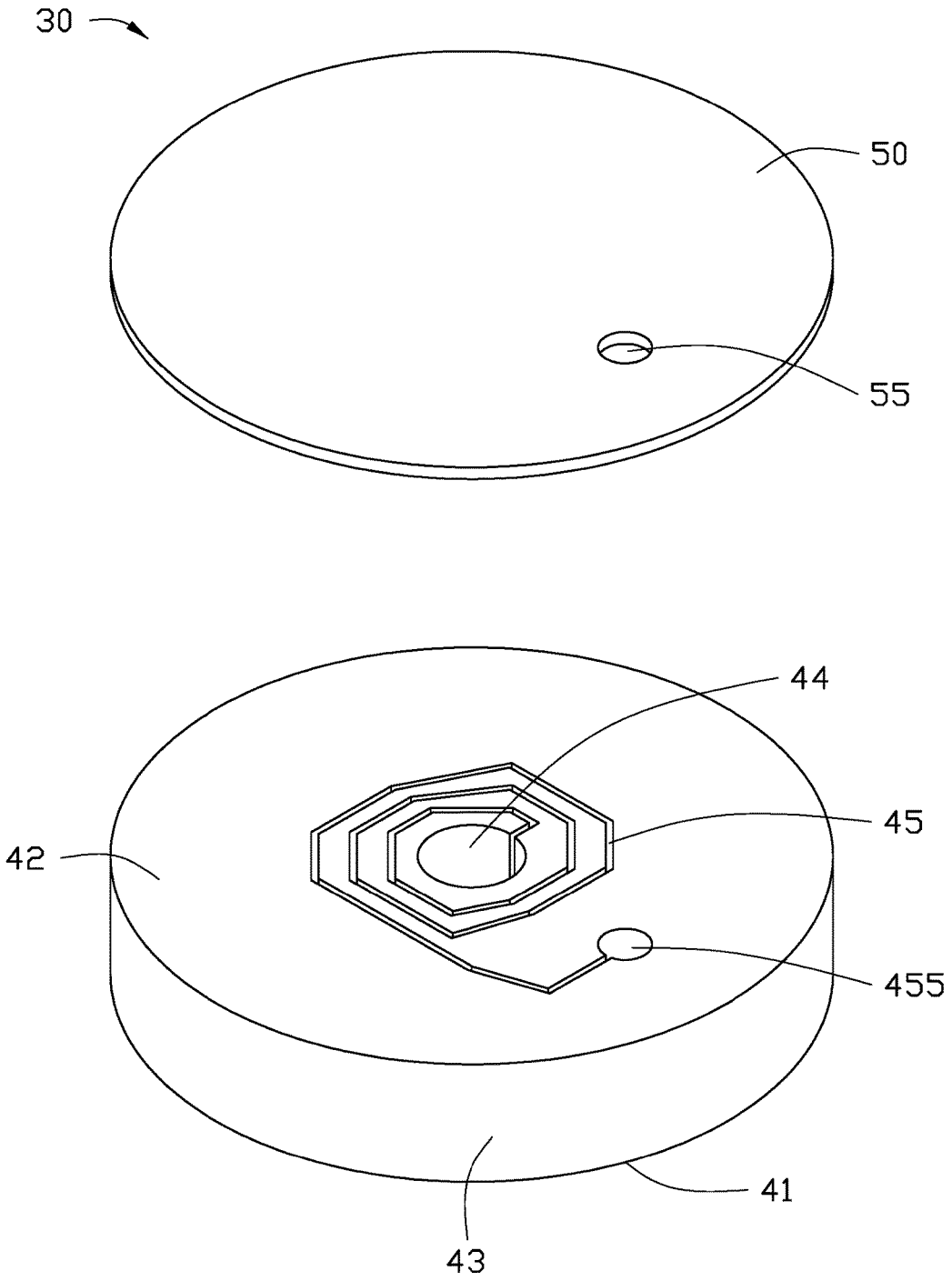
FIG. 2 is exploded, isometric view of a piston of the injection device of FIG. 1.

FIG. 1 and FIG. 2 illustrate one exemplary embodiment of an injection device 100 that includes a needle tube 10, a push rod 20 slidably installed in the needle tube 10, and a piston 30 secured on one end of the push rod 20. The injection device 100 injects a liquid. The liquid may have a relatively high viscosity. The liquid may be vegetable oil, honey, or glycerin for example.

The needle tube 10 is generally cylindrical. The needle tube 10 includes a bottom wall 11 and a sidewall 13. The sidewall 13 surrounds periphery portions of the bottom wall 11 and is perpendicularly connected to the bottom wall 11. The bottom wall 11 and the sidewall 13 together define a receiving space 15 to receive the liquid. The push rod 20 and the piston 30 are slidably mounted in the receiving space 15. The bottom wall 11 defines a pinhole 12, and the liquid can be discharged from the needle tube 10 through the pinhole 12. In at least one embodiment, the needle tube 10 is transparent.

The push rod 20 is substantially cylindrical. The diameter of the push rod 20 is smaller than the diameter of the needle tube 10. One end of the push rod 20 is connected and secured to the piston 30.

Figure 3:
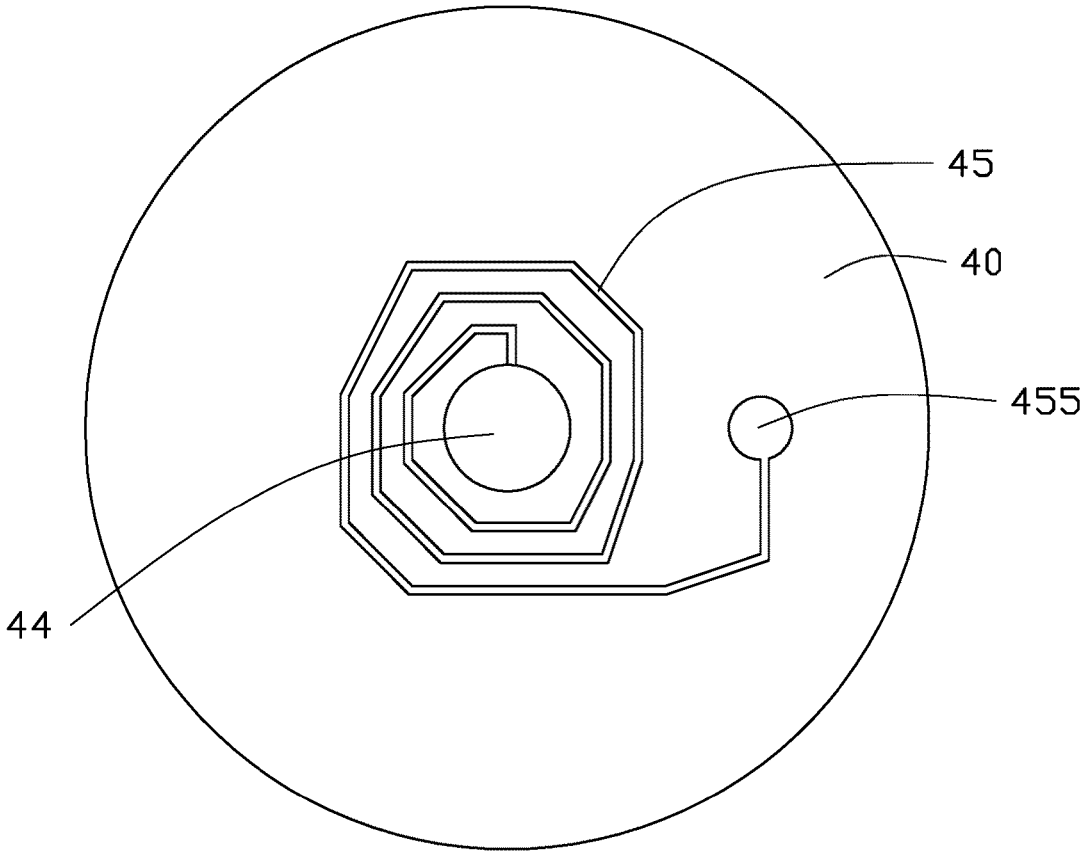
FIG. 3 is view of a main body of the injection device of FIG. 2.
Figure 4:
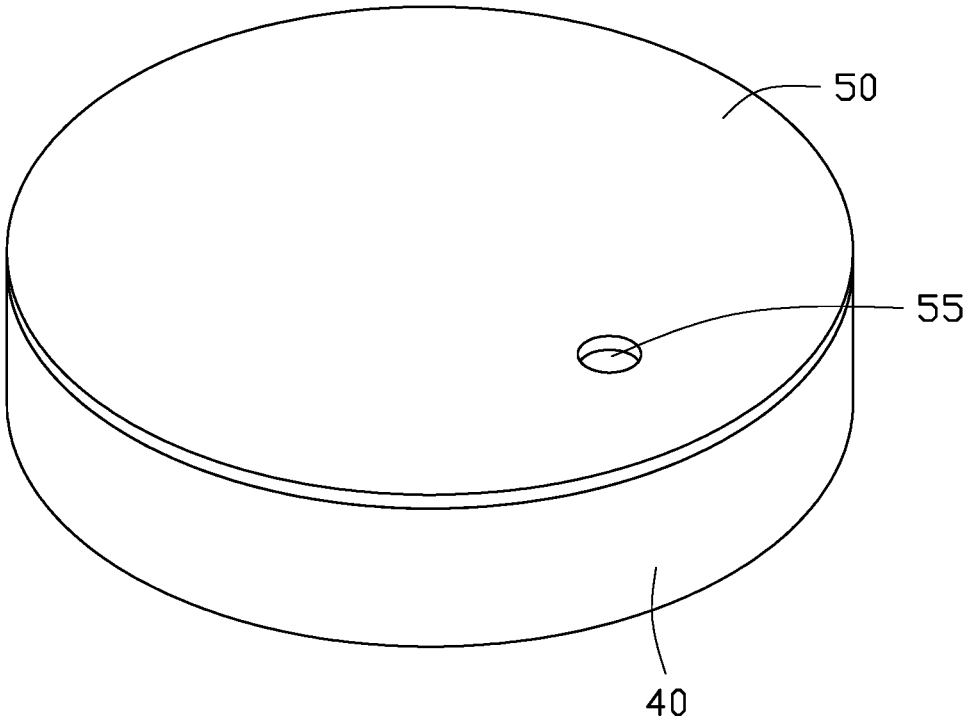
FIG. 4 is an assembled view of the piston of FIG. 2.

FIG. 2 to FIG. 4 illustrate that the piston 30 includes a main body 40 and a cover 50 connected with the main body 40. The main body 40 includes a bottom surface 41, a top surface 42 opposite the bottom surface 41, and a side surface 43. The bottom surface 41 is substantially parallel to the top surface 42 and the bottom surface 41 faces the bottom wall 11. The main body 40 and the cover 50 are in an interference fit with the sidewall 13 of the needle tube 10, and the side surface 43 is in close contact with the sidewall 13.

The main body 40 has a through hole 44 defined in the middle portion of the main body 40. The through hole 44 penetrates the bottom surface 41 and the top surface 42. The main body 40 is also provided with an exhaust passage 45 on the top surface 42. One end of the exhaust passage 45 is in air communication with the through hole 44, and the other end of the exhaust passage 45 is in air communication with an exhaust groove 455. Gas can pass through the exhaust passage 45 and be discharged from the exhaust groove 455. In at least one embodiment, the exhaust passage 45 is designed to be helical. In other embodiments, the exhaust passage 45 may also be of other design, and the present disclosure is not limited thereto.

The cover 50 can be fixed to the top surface 42 of the main body 40 to shield the through hole 44 and the exhaust passage 45. The cover 50 defines an exhaust hole 55 corresponding to the exhaust groove 455, and gas can be discharged from the exhaust hole 55. One end of the push rod 20 is perpendicularly connected to the cover 50. In at least one embodiment, the main body 40 may be formed by rubber injection molding, and the cover 50 may be a plastic film or a rubber film. The main body 40 and the cover 50 may be secured together by means of an adhesive.

When using the injection device 100, the liquid is taken into the receiving space 15 of the needle tube 10. The cover 50 is secured to the top surface 42 of the main body 40, and the exhaust hole 55 is aligned with the exhaust groove 455. The push rod 20 is secured to the cover 50 and is placed in the receiving space 15 together with the piston 30. The bottom surface 41 of the body 40 faces the bottom wall 11.

The push rod 20 is pushed in the direction of the bottom wall 11, and the push rod 20 drives the piston 30 to slide toward the bottom wall 11. When the push rod 20 slides towards the bottom wall 11, or the pressing process, any gas between the piston 30 and the liquid is compressed and enters into the exhaust passage 45 from the through hole 44, then discharges from the exhaust groove 455 and the exhaust hole 55. The push rod 20 thus does not raise the pressure during the pressing process and does not require additional thrust for the piston 30 to be pushed further. When the piston 30 is in contact with the liquid, the liquid is not easily discharged from the exhaust passage 45 due to the high viscosity and the three-dimensional design of the exhaust passage 45.

Figure 5:
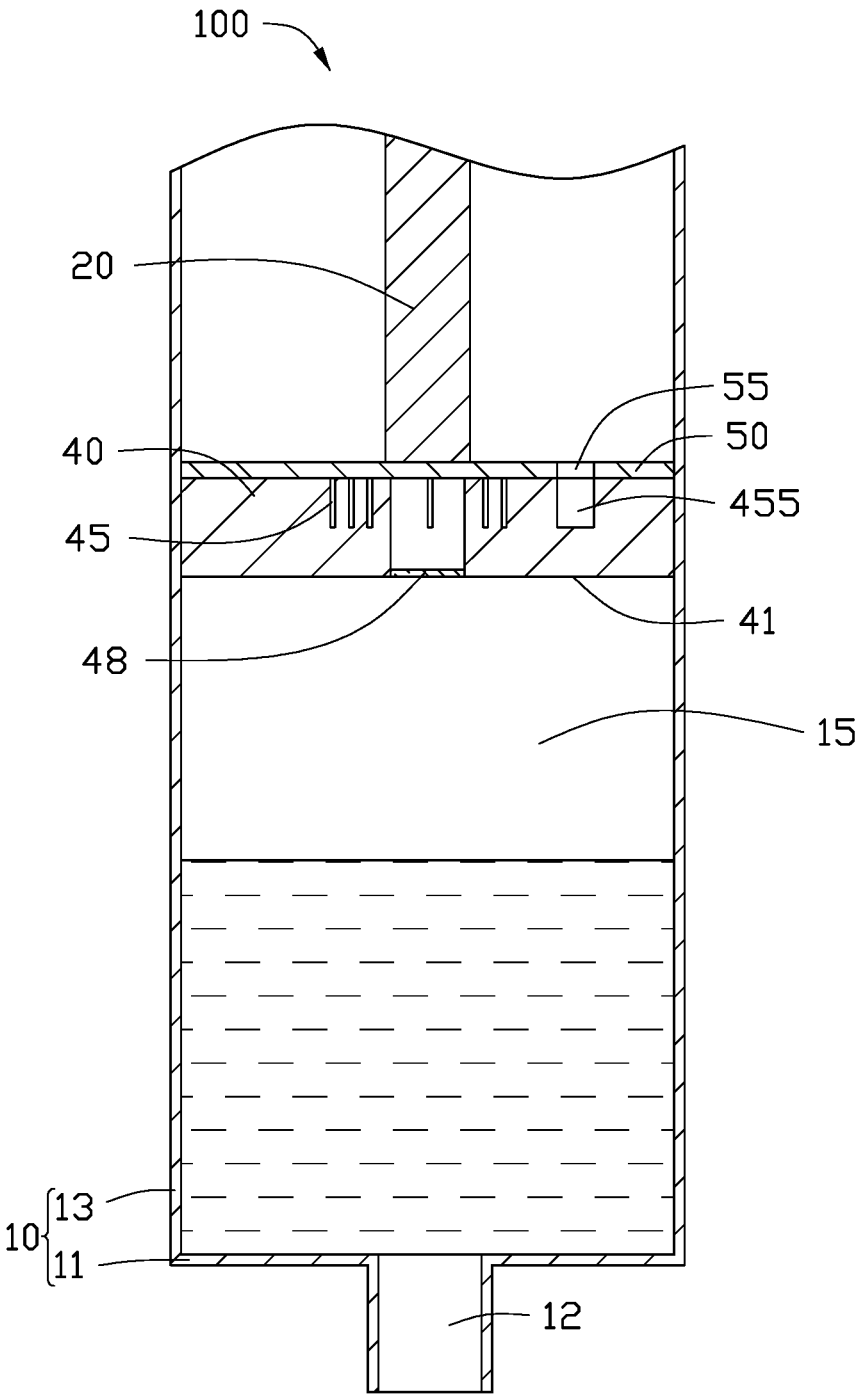
FIG. 5 is a cross-sectional view of another exemplary embodiment of the injection device.

FIG. 5 illustrates another exemplary embodiment of the injection device 100. The bottom surface 41 of the main body 40 is further provided with a water-permeable membrane 48 at the through hole 44 to prevent anything other than gas to be discharged from the exhaust passage 45.

Figure 6:
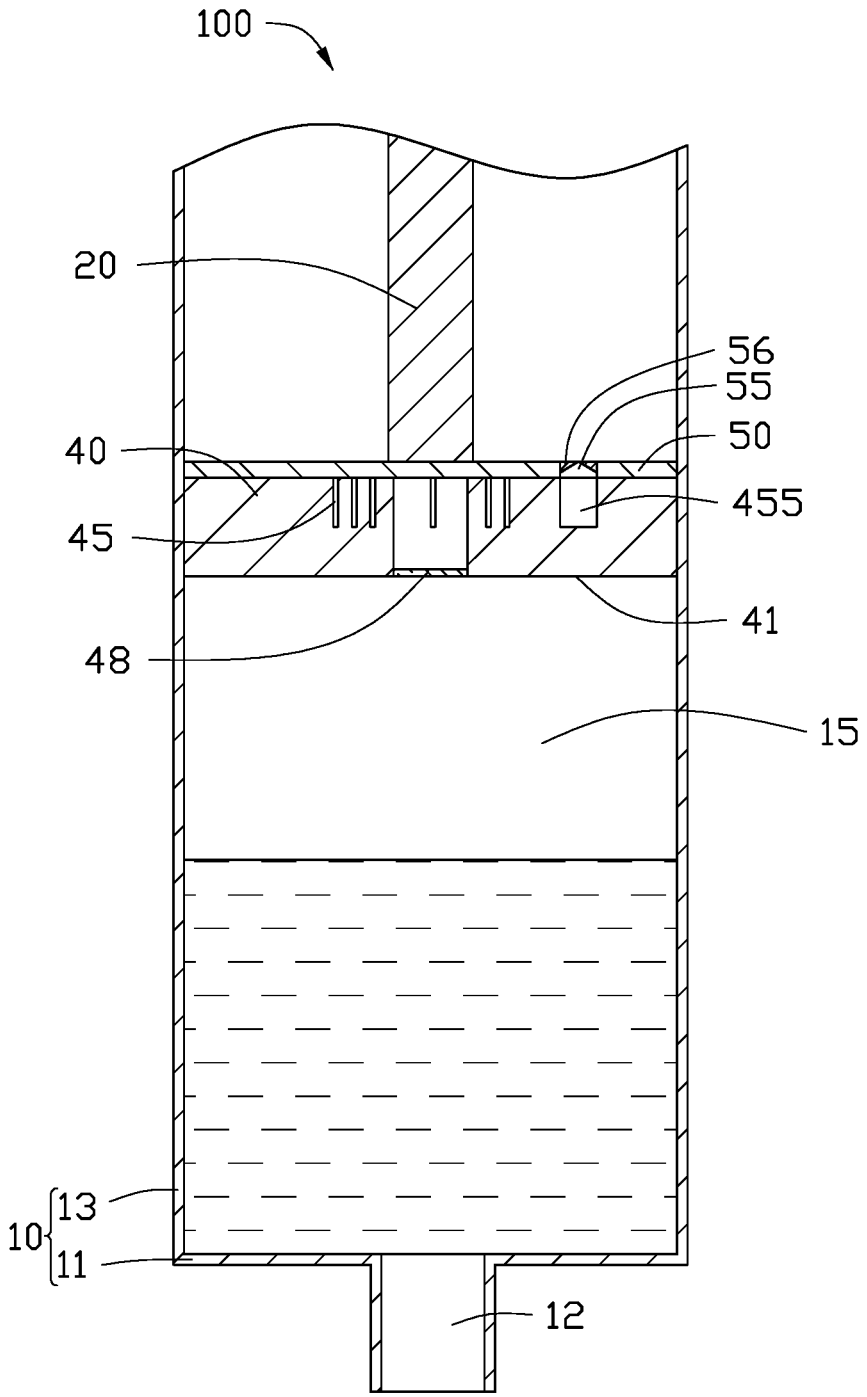
FIG. 6 is a cross-sectional view of another exemplary embodiment of the injection device.

FIG. 6 illustrates another exemplary embodiment of the injection device 100. An exhaust check valve 56 is provided on the exhaust hole 55 of the cover 50. The gas can pass from the exhaust passage 45 through the exhaust check valve 56 but cannot return into the exhaust passage 45 through the exhaust check valve 56. Thus, air from outside of the needle tube 10 cannot enter the exhaust passage 45 from the exhaust hole 55 when the piston 30 is sliding away from the bottom wall 11.

The exemplary embodiments shown and described above are only examples. Many details are often found in the art such as the other features of an injection device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. An injection device, comprising:

a needle tube;

a push rod slidable in the needle tube; and a piston on one end of the push rod, the piston comprising a main body and a cover;

wherein the main body defines a through hole thereon and an exhaust passage, the exhaust passage is helical, one end of the exhaust passage is in air communication with the through hole, the cover is on the main body to shield the through hole and the exhaust passage, the cover defines an exhaust hole in air communication with another end of the exhaust passage to discharge gas from the piston.

2. The injection device of claim 1, wherein another end of the exhaust passage is provided with an exhaust groove, and the exhaust hole of the cover is in air communication with the exhaust groove.

3. The injection device of claim 1, wherein the main body comprises a bottom surface and a top surface opposite to the bottom surface, and the through hole penetrates the bottom surface and the top surface.

4. The injection device of claim 3, wherein the bottom surface includes a water-barrier permeable membrane at the through hole to prevent liquid from entering into the through hole.

5. The injection device of claim 3, wherein the main body further comprises a side surface connected to the bottom surface and the top surface, the main body is in interference fit with the needle tube, and the side surface abuts the sidewall.

6. The injection device of claim 1, wherein the cover further comprises an exhaust check valve on the exhaust hole to prevent gas from entering into the exhaust passage through the exhaust hole.

7. The injection device of claim 1, wherein the needle tube comprises a bottom wall and a sidewall surrounding peripheral portions of the bottom wall, the bottom wall and the sidewall together define a receiving space, the push rod and the piston are slidable in the receiving space.

8. The injection device of claim 7, wherein the bottom wall defines a pinhole, and liquid passes the bottom wall through the pinhole.

9. The injection device of claim 1, wherein the main body is formed by rubber injection molding.

10. The injection device of claim 1, wherein the cover is formed into a plastic film or a rubber film.

11. An injection module, comprising:

an injection device configured to inject liquid, comprising:

a needle tube;

a push rod slidable in the needle tube; and a piston on one end of the push rod, the piston comprising a main body and a cover;

wherein the main body defines a through hole thereon and an exhaust passage, the exhaust passage is helical, one end of the exhaust passage is in air communication with the through hole, the cover is on the main body to shield the through hole and the exhaust passage, the cover defines an exhaust hole in air communication with another end of the exhaust passage to discharge gas from the piston.

12. The injection module of claim 11, wherein another end of the exhaust passage is provided with an exhaust groove, and the exhaust hole of the cover is in air communication with the exhaust groove.

13. The injection module of claim 11, wherein the main body comprises a bottom surface and a top surface opposite to the bottom surface, and the through hole penetrates the bottom surface and the top surface.

14. The injection module of claim 13, wherein the bottom surface includes a water-barrier permeable membrane at the through hole to prevent liquid from entering into the through hole.

15. The injection module of claim 13, wherein the main body further comprises a side surface connected to the bottom surface and the top surface, the main body is in interference fit with the needle tube, and the side surface abuts the sidewall.

16. The injection module of claim 11, wherein the cover further comprises an exhaust check valve on the exhaust hole to prevent gas from entering into the exhaust passage through the exhaust hole.

17. The injection module of claim 11, wherein the needle tube comprises a bottom wall and a sidewall surrounding peripheral portions of the bottom wall, the bottom wall and the sidewall together define a receiving space, the push rod and the piston are slidable in the receiving space.

18. The injection module of claim 17, wherein the bottom wall defines a pinhole, and liquid passes the bottom wall through the pinhole.

19. The injection module of claim 11, wherein the main body is formed by rubber injection molding.

20. The injection module of claim 11, wherein the cover is formed into a plastic film or a rubber film.

* * * * *